US005581287A

United States Patent [19]

Baezner et al.

[11] Patent Number: 5,581,287

[45] Date of Patent: Dec. 3, 1996

[54] INKJET PRINTER INK CARTRIDGE REFILLING STRUCTURE

[75] Inventors: Michael A. Baezner, Missouri City; Lakshminarayan Bettagere, Houston, both of Tex.

[73] Assignee: Jetfill, Inc., Houston, Tex.

[21] Appl. No.: 269,199

[22] Filed: Jun. 30, 1994

[51] Int. Cl.[6] ..... B41J 2/175; B65B 1/04; B65B 3/04

[52] U.S. Cl. ..... 347/85; 141/18; 141/330

[58] Field of Search ..... 347/85, 86, 87; 141/18, 21, 329, 330

[56] References Cited

U.S. PATENT DOCUMENTS

| | | | |
|---|---|---|---|
| 2,554,352 | 5/1951 | Ward et al. | 128/220 |
| 4,303,929 | 12/1981 | Blanck | 347/86 |
| 4,419,677 | 12/1983 | Kasugayama et al. | 346/140 R |
| 4,998,115 | 3/1991 | Nevarez et al. | 347/87 |
| 5,199,470 | 4/1993 | Goldman | 141/1 |
| 5,231,416 | 7/1993 | Terasawa et al. | 347/87 |
| 5,232,447 | 8/1993 | Schwarz et al. | 604/110 |
| 5,329,294 | 7/1994 | Ontawar et al. | 347/87 |
| 5,373,936 | 12/1994 | Kawai et al. | 347/30 |

FOREIGN PATENT DOCUMENTS

| | | | |
|---|---|---|---|
| 58-59850 | 4/1983 | Japan | 347/86 |

OTHER PUBLICATIONS

IBM Technical Disclosure Bulletin, vol. 35, No. 1B, Jun. 1992, "Converting Shipping Container to Work Surface".

*Primary Examiner*—Benjamin Fuller
*Assistant Examiner*—Craig A. Hallacher
*Attorney, Agent, or Firm*—Hitt Chwang & Gaines P.C.

[57] ABSTRACT

The present invention is directed toward an ink cartridge refilling structure having a housing structure with a base structure and a housing lid structure. The housing lid structure has first and second outwardly opening chambers formed therein with a spring biased ink injection device received in the first chamber and an air plunger member with an associated air bellow member received in the second chamber. The base structure has positioned within its interior a moveable carrier member that is secured to a lever that extends outwardly through a slot extending horizontally and longitudinally along the side wall of the base structure. An empty ink cartridge is placed in the carrier member within interior of the base structure and refilled with ink. The carrier member and ink cartridge are then shifted over to the air injection position where air is injected into the air bags of the ink cartridge.

47 Claims, 6 Drawing Sheets

INKJET PRINTER INK CARTRIDGE REFILLING STRUCTURE

TECHNICAL FIELD OF THE INVENTION

The present invention is directed to an apparatus for refilling liquid-containing cartridges and, more specifically, to an apparatus for refilling inkjet printer cartridges.

BACKGROUND OF THE INVENTION

Inkjet cartridges such as those used in inkjet printers are well known in the art. These inkjet cartridges are generally comprised of a printhead and an integral ink container containing the liquid ink to be supplied to the printhead. During printing, ink is expelled from the printhead through various ejection methods. The ink reservoir is drained during this process and eventually emptied. The structural components of the ink cartridge are durable and will last for numerous charges of ink. A substantial cost involved in the use of inkjet printers is the replacement of cartridges; over the life of the printer this cost is often two or three times the cost of the printer itself. Discarding the entire cartridge after the reservoir is emptied once is an expensive and wasteful practice.

As a result of the high cost and waste involved in disposing of a fully functional, empty cartridge, many users refill ink cartridge reservoirs. Techniques have been developed to replenish the ink reservoirs several times, dramatically extending the life of the cartridge.

There are several known methods and apparati for refilling the reservoirs. These methods require four main steps to refill a cartridge: fill hole access, refilling, fill hole sealing, and priming. Various apparati are employed to assist in performing the four main refilling steps.

Aside from requiring a four-step process, all current methods for refilling ink reservoirs require a certain level of skill to accomplish successfully. As a result, these methods are often messy and may not yield a properly functioning cartridge. Consequently, the widespread acceptance of refilling inkjet cartridges has been limited.

All of the steps of the refill process present the risk of an messy ink spill. Aside from step-specific tools that may be provided by a cartridge refill manufacturer, refill kits may also include a container to hold the cartridge or some absorbent material on which to place the cartridge while the refill process is performed. A common cartridge container is comprised of an open-ended cardboard box lined with absorbent material on the side that will contact the printhead of the cartridge. The purpose of the container or the absorbent material is to minimize the damage caused by ink spills. Containers are used during the entire process, whereas absorbent material may be used as a place-mat for the cartridge during the entire process or merely to wipe the printhead of a cartridge and clean excess ink after the refill process has been performed.

The first step in refilling an inkjet cartridge is to provide access to the ink reservoir through the fill hole. Some cartridges have a small ball that seals the fill hole of the ink reservoir. To access the fill hole, the ball is dislodged into the interior of the reservoir. This operation is accomplished by either an ordinary pressing instrument such as a ball-point pen or a tool that has been specially designed for easier alignment and more ergonomic operation.

Previously refilled cartridges may have a plug covering the fill hole where the small ball originally was located. These cartridges are refilled by removing the plug from the hole. This is often difficult because of the tight fit of the plug and is very difficult to remove by hand.

Other previously refilled cartridges use an Allen head set screw to seal the fill hole. The set screw is removed using an Allen head wrench to unscrew it. This task is time consuming, often taking over thirty seconds to complete. An additional drawback to this method is that the user may accidentally turn the set screw the wrong way, causing the set screw to fall into the reservoir area, preventing its removal for future sealing.

Some cartridges have a septum which is penetrated by a needle to reach the ink reservoir. Once the needle is removed, the septum seals the hole made by the needle and provides an airtight seal. Cartridges may come with a septum from the original manufacturer or a septum may be inserted into the fill hole after dislodging a ball sealing the ink reservoir. However, there are certain disadvantages with this system as well. For instance, the insertion of the septum in a cartridge not originally equipped with one is difficult because of the tight fit between the septum and the small fill hole.

Other cartridges use a stationary vent plug. The plug allows air to pass into the ink reservoir to prevent a vacuum from forming as ink is expelled. At the same time, the plug limits evaporation by minimizing airflow; this is achieved through the use of a small air passageway which can make several right angle turns. This results in a passageway too small and too angled for ink to be delivered through effectively. In this type of cartridge, two solutions to accessing the reservoir exist. The first is simply to remove the vent plug entirely. The removal of the vent plug is difficult and requires special tools to grip and pull the vent plug out of its resting place. A second method, more commonly used in refill processes, is to create a hole in the vent plug large enough for ink to pass through quickly. The hole may be made by a variety of hand driven tools such as an auger or screw-eye rotated to bore a hole through the vent plug, as disclosed in U.S. Copyright Reg. No. TX 2-548-168 and later stated in U.S. Pat. No. 5,199,470. Other methods, as disclosed by U.S. Pat. No. 4,589,000, include piercing a hole through the vent plug with a sharp pointed object by hand, but this requires considerable force to perform.

Some cartridges have a top covering both the cartridge and fill holes which is not in direct contact with the otherwise unobstructed fill holes. This reduces evaporation and also makes the cartridge easier to install in the printer. In order to refill this cartridge, the top must be removed by breaking the ultrasonic bonds that hold it in place. This is difficult to do and usually requires special tools to ensure that force is applied to the correct areas of the cartridge. Once the top is broken off, the fill holes are exposed and ready to be filled. Other methods replace the old top with one with columns giving constant access to the fill holes. Some refill methods provide a cartridge that has been modified by the refiller to give access to the fill holes.

The last category of cartridges has a constantly exposed fill hole. These cartridges rely on a foam sponge and/or sit upright to keep the contents of the ink reservoir from leaking and/or evaporating excessively.

The second step in the cartridge refilling process is the actual filling of the ink reservoir through the fill hole. A common method, such as disclosed in U.S. Pat. No. 5,199,470, employs the use of an accordion-style bellows bottle commonly known as a Boston bottle. The user compresses the bottle to force ink out of the container through the fill hole and into the reservoir. This method could result in ink spilling out of the cartridge and injector tube, creating a mess. Another drawback of this method is that not all ink can be easily drained out of the bellows bottle unless it is held at a specific orientation and is allowed to breathe air. Also, the bellows bottle is hard to compress.

Another popular method of filling the ink reservoir employs a non-reusable syringe as disclosed in U.S. Pat. No. 5,232,447 or a standard syringe to inject ink into the reservoir. The injector tube (needle) of the syringe is inserted by hand into the reservoir through the fill hole. Then the plunger of the refill is pressed by hand until the proper amount of ink has been dispensed or the refill unit is empty. This method also can prove to be messy, but it is easier to use and does not waste as much ink as the bellows bottle method.

The use of squeeze bottles to fill ink reservoirs is also popular. These bottles are not Boston bottles, but do dispense ink by compression. The injector is inserted through the fill hole into the reservoir. At that point the sides of the bottle are squeezed causing the ink to be dispensed. Again, this process can be messy and difficult and requires special orientation and air breathing to dispense all ink.

The last of the methods known in the art of refilling cartridges takes advantage of gravity to dispense ink into the reservoir. The ink container may be of any shape or size containing one recharge of ink. An injector tube attached to the container passes through the fill hole into the reservoir carrying the ink. The ink flow begins when a small air hole is punctured in the top of the ink container releasing the vacuum that impedes the flow of ink from the container. A major drawback to this method is that it takes a long time, often several minutes, to refill a cartridge. The ink dispensing process is not easily stopped once started and is impossible to stop in cartridges that do not use a septum. This can result in ink spills when the cartridge is overfilled or the apparatus is accidentally knocked over.

Once the ink reservoir has been refilled, the third step of the cartridge recycling process is to seal the fill hole. The simplest fill hole resealing method requires a rubber plug to be pressed into the fill hole by hand. Plugs make an excellent seal, but requires the exertion of uncomfortable amounts of force. Residual ink around the fill hole may stain the user's hands while performing this step from or, worse yet, accidentally tilting or tipping over the cartridge during this process could cause an ink spill.

An alternative to inserting a plug in small areas where it is hard for the user to manipulate his/her hands is to use an Allen head set screw. The set screw is twisted into place by a hex key after filling. The drawbacks to this method of sealing are the long amount of time to twist the screw into place, the high level of dexterity required to twist the screw into place, and the chance that the user may twist the set screw too tightly causing it to fall into the reservoir where it can not be reached.

The vent plug is simply replaced on cartridges with removable vent plugs. The plug is either pushed back into place by hand or using an auger. This is a simple process, but may result in ink on the user's hands from residual ink around the file hole.

Some refill kits supply a new apparatus to cover the area where the vent holes are located to replace one removed at the beginning of the refill process. Other similar ideas use an additional piece to join the cover to the file hole area. These pieces are press fit into place by the user and are generally simple to use.

Cartridges with a septum covering the reservoir area are automatically sealed as the filling device is withdrawn. The septum forms an air and liquid tight seal and no work is required on the part of the user to seal the reservoir.

The last option after filling the reservoir is to leave the fill hole open. On certain cartridges, where evaporation and ink leakage are not concerns, the fill hole may be left open. In fact some cartridges come from the original manufacturer with an open fill hole. This method, like the septum, requires no work on the part of the user.

The fourth step of the inkjet cartridge recycling process requires the cartridge to be primed, usually by the injection of air into the sealed cartridge. A primed cartridge has the pressure of the ink at the nozzle within a specific range, allowing the cartridge to function. Forcing air through the vent will prime the cartridge. Ink is expelled through the printhead as air is forced into the reservoir through the vent hole by squeezing a bulb, depressing a syringe, or by blowing into the vent hole. Any air that may have been introduced into the printhead before or during refilling is expelled along with the ink in this process. The resulting cartridge is primed and ready to print just like an original factory cartridge. The disadvantage of the current methods of priming available is that the process requires the user to perform an extra step by using an additional apparatus or by blowing into the cartridge with his/her mouth.

Some inkjet cartridges have internal pressure control mechanisms that are used to maintain the slight negative pressure required for inkjet printing. The pressure control mechanisms are comprised of air bags residing in the reservoir. In order to prevent internal pressure from equalizing with external pressure when an ink cartridge reservoir is refilled, some refill methods prevent the pressure control mechanisms from adjusting during the refill process. This is done by covering the vent hole (leading to the air bags) before opening the fill hole, during refilling, and until after the fill hole has been sealed. Manufacturers of cartridge refill kits may supply a specialized tool for this task. The result is that the pressure control mechanisms are maintained in an excessively expanded position and occupy significantly more volume of the reservoir than is necessary for proper functioning after refilling. This prevents a full replenishment of the reservoir as the available volume of the reservoir will only hold approximately three-fourths of the original amount of ink.

Other methods allow the pressure control mechanisms to adjust during the refill process and then require the mechanisms to be adjusted to the appropriate levels after filling the reservoir. This allows a full replenishment of the ink reservoir but requires more work on the part of the user. These methods generally rely on a squeezable "priming" bulb to inflate the air bags after filling the reservoir. This can be done either before or after sealing the fill hole. When the fill hole is sealed after the air bags are inflated, a certain volume of air is injected into the air bags, thus displacing a certain amount of volume in the reservoir. The fill hole is then sealed while the air bags are still in the inflated position and volume of the reservoir (and the air in it) is at a decreased level. Once the fill hole is sealed, the inflation device is removed from the vent hole and the air bags partially deflate, thus forming a negative pressure in the reservoir as the volume increases, but the amount of air and ink in the reservoir is unchanged.

Two methods can be used to adjust the pressure control mechanisms after the fill hole has been sealed. The first method uses a squeezable "priming" bulb or syringe to inflate the air bags after sealing the fill hole. The pressure in the reservoir is at ambient pressure when the fill hole is sealed. When the vent hole is inflated, the air bags expand and force ink out of the reservoir through the printhead and bubble generator. This is caused by increased pressure in the reservoir from the air bags attempting to expand and reduce the reservoir volume. The user is instructed to continue to expel ink several times until the cartridge stops leaking. Once enough ink has been expelled from the cartridge the required negative pressure is achieved since no additional air is allowed into the reservoir. This is a messy method and usually two or three milliliters of ink are expelled from the cartridge before it is primed.

The second method of adjusting the pressure control mechanisms after the fill hole has been sealed is similar to the first except that the air bags are not inflated to expel ink. Instead this method relies on gravitational force and the fact that the reservoir is not at the correct negative pressure to achieve a slow drip of ink from the printhead. This continues until the same amount of ink is expelled and the correct negative pressure is achieved as in the previous method; the user is not required to do anything except wait ten to fifteen minutes.

One type of cartridge, comprising an ink bag and a septum, does not require any work on the part of the user to be primed. No air is in the cartridge as it is sealed off by the septum and no air is injected during the refilling process. These cartridges are the simplest type to prime as the printer automatically primes the ink tubes and does not even require the user to request priming.

As mentioned, the known art includes several devices to assist in the refill process. Most refill devices can be classified as specialized tools that assist one particular step of the refill process. There is at least one known device that attempts to combine the steps into a process that is easier for the user. The known device comprises a washable, durable container to hold a cartridge during the refill process. The container has rubber plugs at the bottom to seal the print orifices and bubble generator, thereby preventing the flow of ink. A two-piece cap is manually inserted on the container one piece at a time. The first piece seals the vent hole. The second piece opens the fill hole of a cartridge by punching out the ball seal. An ink vessel is then coupled to the cap to fill the cartridge ink reservoir via gravitational flow. After the ink has drained from the vessel, the second piece of the cap is removed and the fill hole is manually sealed with a rubber plug. The system is slow because of its use of gravitational flow for the fill process. It also has no priming means. Consequently, the ink reservoir cannot be completely filled if the cartridge uses an air bag pressurization system. The problem of ink spillage is not eliminated by the system: large amounts of ink may be spilled if the device is toppled during the refill process.

Accordingly, it is seen that there is a need in the art for an efficient, easy-to-use, inexpensive cartridge refilling device that may be used by an individual to refill an inkjet cartridge. The device of the present invention provides a solution to this need.

SUMMARY OF THE INVENTION

To address the above-discussed deficiencies of the prior art, the present invention provides an ink refilling apparatus for use with an ink refill cartridge for refilling an ink cartridge. The ink refilling apparatus of the present invention is comprised of a housing structure having a top portion that is configured to receive an ink cartridge therein, a liquid (e.g. ink) injector herein referred to as "ink injection means" received in the top portion for injecting liquid into the ink cartridge and an air injector herein referred to as an "air injection means" also received in the top portion for injecting air into the ink cartridge positioned. The ink injection means are configured to receive an ink refilling cartridge and allow a flow of ink from the ink refilling cartridge into an ink cartridge positioned within the housing structure. The air injection means are configured to allow a flow of air from the air injection means into the ink cartridge.

In another embodiment of the present invention, the top portion of the ink refill apparatus has formed therein a first chamber opening outwardly from the top portion having a side wall and a base wall and a second chamber formed in and opening upwardly from the top portion of the housing structure. The first chamber is configured to receive the liquid injection means therein and also has an opening therein for providing fluid communication between the ink injection means and the ink cartridge positioned within the housing structure. The second chamber is configured to receive the air injection means and has an opening therein for allowing air to flow from the air injection means to the interior of the ink cartridge positioned within the housing structure. Preferably, the top portion of the housing structure is a pivotally mounted housing lid structure having a top side surface and a side wall depending from the top side surface and the housing structure comprises a base wall, a side wall extending upwardly from the base wall to form an open top portion thereof. Further, the housing lid structure preferably includes a latch assembly herein referred to as "latch means" for latching the housing lid to the housing lid structure to prevent the housing lid structure from being lifted to an open position when the ink cartridge carrier member is in the second position. The latch means may be comprised of a latch means support structure integrally formed on the interior of the side wall of the housing structure, a vertically oriented, elongated lever pivotally mounted at a longitudinal intermediate location thereon having oppositely directed transversely projecting upper end and lower end portions with the upper end portion being cooperable with a latch opening formed in the side wall of the housing lid structure and the lower end portion of the housing lid latch means being operable against the side wall of the ink cartridge carrier member when it is positioned under the liquid injection means, and a housing lid latch member resilient assembly herein referred to as "resilient means" for pivotally biasing the upper end of the housing lid latch means into the latch opening when the ink cartridge carrier member is positioned under the air injection means.

In another aspect of the embodiment just described, the ink injection means comprises an ink refill cartridge housing member that is slidably received in the first chamber having a side wall extending upwardly from a base wall to form an open top portion thereof, an ink refill needle formed within the base wall of the ink refill cartridge housing member. The ink refill needle has a first end that extends into the ink refill cartridge housing and a second end that extends outwardly from the base wall. The ink injection means further comprises a tubular member integrally formed with and extending outwardly from the base wall and is configured to receive the second end of the ink refill needle therethrough and a resilient means positioned between the base wall of the ink refill cartridge housing and the base wall of the first chamber for exerting an upwardly projecting force against the ink refill cartridge housing.

In this same embodiment, the air injection means comprises an air bellow member, an air plunger having a bottom wall that is operable against the air bellow member, that is slidably received in the second chamber and affixed to and extending downwardly from the bottom wall of the air plunger member. The air injection means may further comprise a seal ball opening for allowing a seal ball to be forced therethrough by a ball ram and into the ink injection port of an ink cartridge to effectively seal it.

In yet another embodiment, the ink refill cartridge housing member further comprises a lid member pivotally mounted to it for covering the open top portion of the ink refill cartridge housing member and a latching assembly herein referred to as "latching means" for latching the lid to the ink refill cartridge housing member to prevent the lid from being lifted to an open position when the ink refill cartridge housing member is in an upward position. The lid member has a top side surface and an outer edge side wall depending from the top side surface. Preferably, the latching means comprises a vertically extending slot formed through the side wall of the ink refill cartridge housing member having a lower end terminating within the side wall of the ink refill cartridge housing member and a vertically extending, flexible, elongated lever member positioned in and coplanar with the vertically extending slot. The lever member has a first stationary end formed within the side wall at the point of termination of the lower end of the vertically extending slot and a second movable end engageable with a latching indentation formed within an interior surface of the outer edge side wall of the lid member. The lever member further has a projection member extending outwardly therefrom and operable against the side wall of the first chamber to thereby disengage the second end from the latching indentation in an inwardly direction when the ink refill cartridge housing is pressed downwardly.

In another aspect of the embodiment just described, the housing lid member may further have a ball chute formed inwardly through its side wall. The ball chute has a first end opening outwardly from the side wall of the housing lid structure, a second end opening into the air injection means and a chute portion extending inwardly from the first end to the second end. The chute portion is angled downwardly with a sufficient degree of slope to cause a seal ball to roll downwardly from the first end to the second end to be operatively positioned in the seal ball opening formed in the air injection means.

In yet another embodiment, the housing structure has received therein an ink cartridge carrier member. Preferably, the ink cartridge carrier member is movable from a first position to a second position within the housing structure by a lever member that is secured to the ink cartridge carrier member and extends outwardly from the side wall of the housing structure through slot formed therethrough and extending longitudinally and horizontally along the length of the side wall. This particular embodiment may also include a register assembly herein referred to as "register means" for receiving and properly aligning the ink cartridge carrier member as the ink cartridge carrier member is moved between the first and second positions.

The foregoing has outlined rather broadly the features and technical advantages of the present invention so that the detailed description of the invention that follows may be better understood. Additional features and advantages of the invention will be described hereinafter which form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
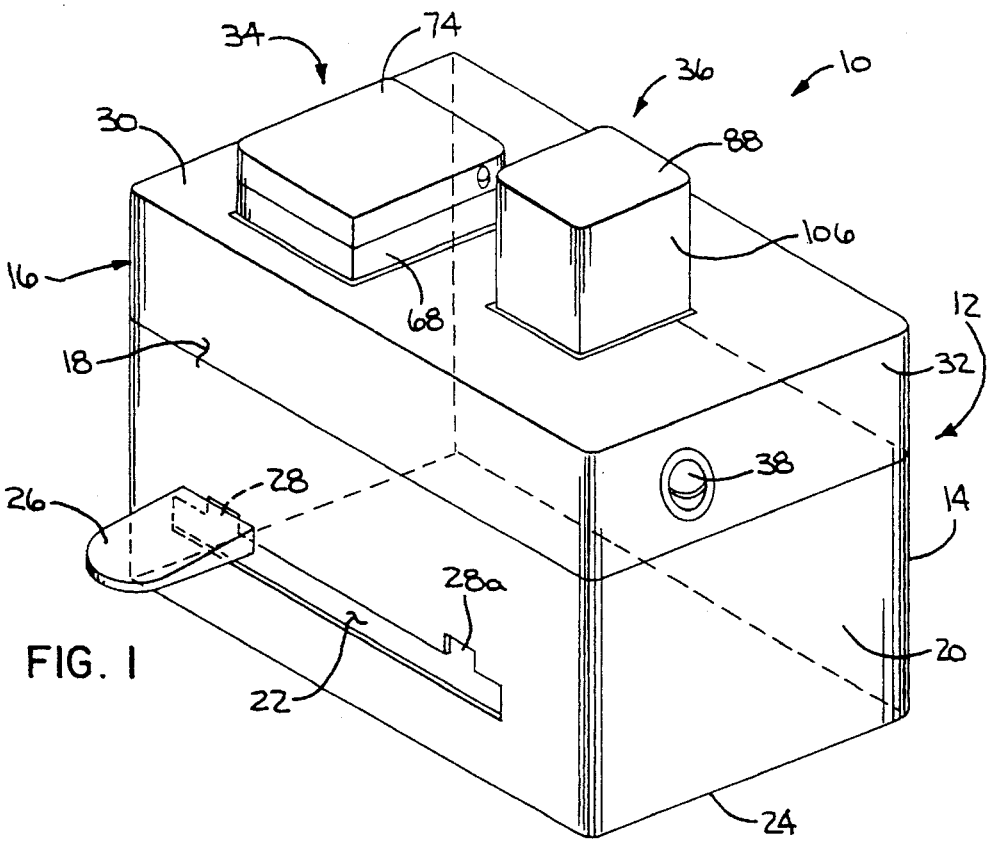
FIG. 1 illustrates an exterior perspective view of a preferred embodiment of the ink cartridge refilling structure in the closed position.
Figure 1A:
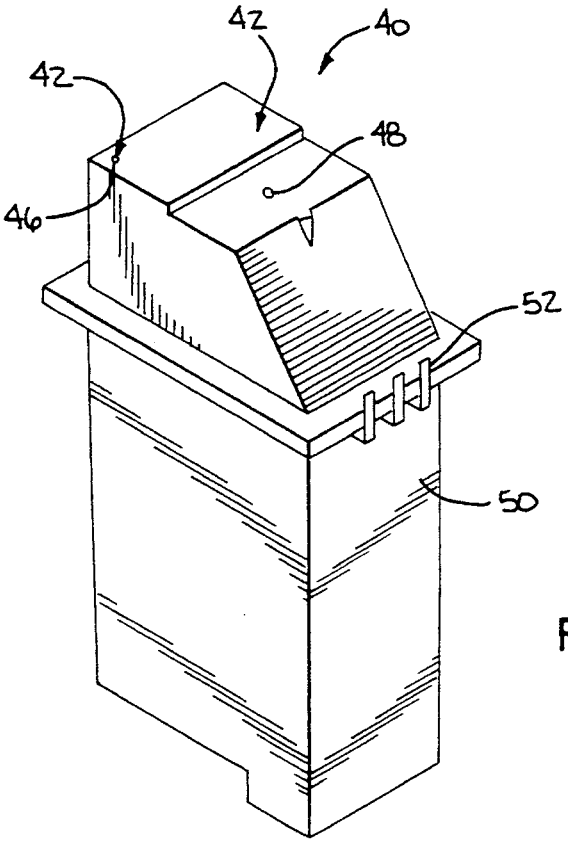
FIG. 1A illustrates a perspective view of a conventional inkjet printer ink cartridge with a sealed air opening in the top portion.

Referring initially to FIGS. 1 and 1A, there is illustrated, in a preferred embodiment thereof, an inkjet printer cartridge refilling structure 10. The inkjet printer cartridge refilling structure 10 is preferably a housing structure 12 having a base structure 14 with a hollow interior portion for receiving and holding a conventional ink cartridge, a housing lid structure 16, an open top portion 18, a side wall 20 having a slot 22 therethrough extending longitudinally and horizontally along the length of the side wall 20, and a base wall 24. The slot 22 is configured to receive therethrough, a lever 26 that extends outwardly from and into the interior of the base structure 14. The slot 22 preferably has formed therein locator slots 28 and 28*a* that are positioned on opposite ends of the slot 22 for correctly positioning and securing an ink cartridge within the interior of the base structure 14 in as hereinafter described below.

The housing lid structure 16 has a top surface 30 with side walls 32 depending downwardly therefrom. The housing lid structure 16 may be either slidable on or completely removable from the base structure 14, or alternatively, it may be pivotally mounted to the base structure 14. Positioned within the top surface 30 of the housing lid structure 16 are an ink injection means 34 for unsealing and refilling an empty ink cartridge and an air injection means 36 for injecting air into and sealing an ink cartridge. The housing lid structure 16 also has formed in its side wall 32 a seal ball chute 38 for receiving a seal ball (not shown). The seal ball chute 38 extends inwardly into the interior of the housing lid structure 16 and interconnects with the air injection means 36 in a manner hereinafter described below.

In FIG. 1*a*, a conventional high capacity ink cartridge 40 is illustrated. The ink cartridge 40 has a top surface 42 with an ink filing port 44 positioned in a corner that is sealed by a seal ball 46. Also positioned in the top surface 42 is a two-way air injection port 48 through which the interior of the ink cartridge 40 is partially pressurized. Extending outwardly from a side wall 50 of the ink cartridge 40 is a securing tab member 52 for securing the ink cartridge 40 in an ink jet printer (not shown). Positioned on the bottom of the ink cartridge 40 are a inkjet printhead and a bubble generator (not shown).

Figure 2:
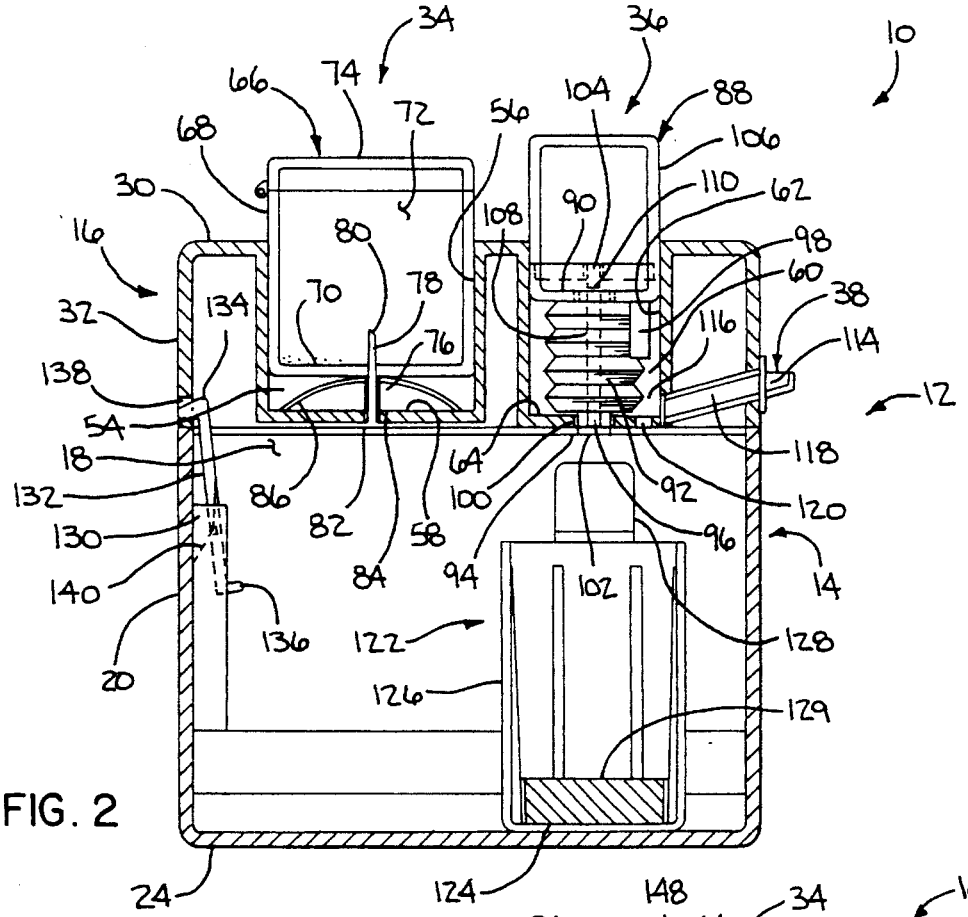
FIG. 2 illustrates a cross-sectional front side view of the ink cartridge refilling structure.

Turning now to FIG. 2 there is illustrated, in a preferred embodiment thereof, a cross-sectional front side view of the inkjet cartridge refilling structure 10. The top surface 30 of the housing lid structure 16 has formed therein a first chamber 54 that opens outwardly through the top surface 30 for supporting the ink injection means 34. The first chamber 54 has an interior side wall 56 and an interior base wall 58. Also formed in the top surface 30 is a second chamber 60 that opens outwardly through the top surface 30 for supporting the air injection means 36. The second chamber 60 also has an interior side wall 62 and an interior base wall 64.

The ink injection means 34 preferably includes an ink refill cartridge housing member 66 for receiving and holding an ink refill cartridge. The ink refill cartridge housing member 66 has an exterior side wall 68 extending upwardly from a base wall 70 to form an interior portion thereof and an open top portion 72. The open top portion 72 is coverable by a lid member 74 that is pivotally mounted to the exterior side wall of the ink refill cartridge housing member 66. The ink refill cartridge housing member 66 is slidably received in the first chamber 54. Integrally formed with and extending outwardly from the base wall 70 is a tubular member 76, and integrally positioned within the base wall 70 is a hollow ink refill needle 78. The refill needle 78 has a sharp pointed end 80 that extends into the interior portion of the ink refill cartridge housing member 66 and a circular end 82 that extends into the tubular member 76. The sharp pointed end 80 is configured to easily pierce an ink refill cartridge while the circular end 82 serves the purpose of removing the seal ball 46 (see FIG. 1*a*). The tubular member 76 not only stabilizes and more properly aligns the refill needle 78 but it also aids in removing the seal ball 46 from the ink filling port 44 (see FIG. 1*a*).

Formed through the base wall 58 of the first chamber 54 is an opening 84 for allowing the ink refill needle 78 and the tubular member 76 to project downwardly therethrough and into the interior of the base structure 14. While a rather detailed embodiment of the ink injection means 34 has just been described, it will be appreciated that the ink injection means 34 could also simply consist of a chamber with an opening therein in those instances where the refill needle is formed in the ink refill cartridge itself.

Positioned between the base wall 58 of the first chamber 54 and the base wall 70 of the ink refill cartridge housing member 66. is a resilient means 86 for applying an upwardly projecting force against the base wall 70 of the ink refill cartridge housing member 66. Preferably, the resilient means 86 is a flat spring or coil spring member.

Positioned in the second chamber 60 is the air injection means 36. The air injection means 36 is preferably comprised of an air plunger member 88 that is slidably received by the second chamber 60. The air plunger member 88 has a bottom wall 90. Closely adjacent the bottom wall 90 is a flexible, resilient air bellow member 92 having a bottom end member 94 with an air bellow opening 96 therethrough and extending into the air bellow member 92. Extending downwardly from the bottom wall 90 and adjacent the side of the air bellow member 92 is a ball ram member 98 for forcing a seal ball (not shown) into the ink filling port 44 of the ink cartridge 40. When the air bellow member 92 is not compressed, the bottom end member 94 of the air bellow member 92 is closely adjacent to an air injection opening 100 formed through the base wall 64 of the second chamber 60 but does not extend through the air injection opening 100 into the base structure 14. However, when the air bellow member 92 is fully compressed, the air bellow opening 96 extends slightly beyond the air injection opening 100 of the second chamber 60 and into the interior portion of the base structure 14.

Affixed to the bottom end member 94 of the air bellow member is a seal member 102 that seals against the top surface 42 and around the air injection port 48 of the ink cartridge 40 (see FIG. 5) when the air bellow member 92 is fully compressed. The rubber seal 102 seals the air bellow opening 96 against the top surface 42 of the ink cartridge 40 and thereby allows more air to enter the ink cartridge 40 when the air is injected by the air bellow member 92.

The air plunger member 88 is secured within the second chamber 60 by air plunger tab members 104 (shown in phantom) positioned on the exterior side wall 106 of the air plunger that slidably engage a vertically extending recessed portion 108 formed in the interior side wall 62 of the second chamber 60. As the air bellow member 92 expands upwardly to its uncompressed configuration, the air plunger tab member 104 lockingly engage an upper end 110 of the recessed portion 108. The air plunger tab members 104 are identical in structure and configuration as retaining tab members associated with the ink injection means 34 and hold the air plunger member 88 within the second cavity 60 in the same manner as hereinafter described below.

Extending inwardly through the side wall 32 of the housing lid structure 16 is a seall ball chute 38 having a first end 114 opening outwardly from the side wall 32 of the housing lid structure 16, a second 116 end opening into the lower portion of the second chamber 60 and a chute portion 118 extending inwardly from the first end 114 to the second end 116. The chute portion 118 is angled downwardly with a sufficient degree of slope to cause the seal ball 46 to roll downwardly from the first end 114 to the second end 116 of the seall ball chute 38 and into the lower portion of the second chamber 60 where it rests in a seal ball opening 120. The seal ball opening 120 is formed through the base wall 64 of the second chamber 60 and opens into the interior of the base structure 14.

Positioned within the interior of the base structure 14 of the housing structure 12, is a carrier member 122 configured to receive and hold a conventional high capacity ink cartridge as the carrier member is moved from a first position to a second position within the interior of the base structure 14. Preferably, the carrier member 122 has a bottom wall 124 and a side wall 126 extending upwardly from the bottom wall 124 a distance sufficient to adequately receive and hold an ink cartridge. The carrier member 122 may also have an ink cartridge securing clip means 128 positioned on and projecting upwardly from its side wall 126 for engaging the securing tab member 52 of the ink cartridge 40 (see FIG. 1*a*) and securely holding the ink cartridge 40 in position within the carrier member 122. The carrier member 122 is preferably slidable between an ink injection position and an air injection position within the interior of the hollow base structure 14. However, it will, of course, be appreciated other variations of this basic configuration are possible that will achieve the same results. For example, the carrier member 122 may be in a fixed position with a carrier member 122 being fixed at each of the ink injection positions and the air injection positions. Alternatively, the housing lid structure 16 may be slidable which would allow a user to slide the ink injection means 34 over the carrier member 122 containing an ink cartridge. and then slide the air injection means 36 over the same position.

Interiorly positioned on the bottom wall 124 of the carrier member 122 is a sealing pad member 129 for sealing the printhead orifices and the bubble generator of the ink cartridge when the ink cartridge 40 is placed therein. The sealing pad member 129 prevents ink from leaking from the cartridge during the refilling process.

The interior portion of the base structure 14, may also include a latch member support structure 130 that is integrally formed on the interior of the side wall 20 of the base structure 14. The latch member support structure 130 supports a latch member 132 that latches the housing lid structure 16 to the hollow base structure 14 so that it cannot be lifted or removed during the air injection and sealing process. Preferably, the latch member 132 is a vertically oriented, elongated lever that is pivotally mounted at a longitudinal intermediate location thereon and that has oppositely directed transversely projecting upper end and lower end portions 134,136, respectively. The upper end 134 is cooperable with a latch opening 138 that is formed in the side wall 32 of the housing lid structure 16. The lower end 136 of the latching member 132 is operable against the side wall 126 of the carrier member 122 when the carrier member 122 is positioned under the ink injection means 34. A resilient means 140 pivotally biases the upper end 134 of the latching member 132 into the latch opening 138 when the carrier member 122 is positioned under the air injection means 36 thereby securing the housing lid structure 16 to the base structure 14. When the carrier member 122 is positioned under the ink injection means 34, the side wall 126 of the carrier member 122 pushes against the lower end 136 of the latch member 132 and overcomes the force of the resilient means 140, thereby pivoting the upper end 134 of the latch means out from the latch opening 138.

Figure 3:
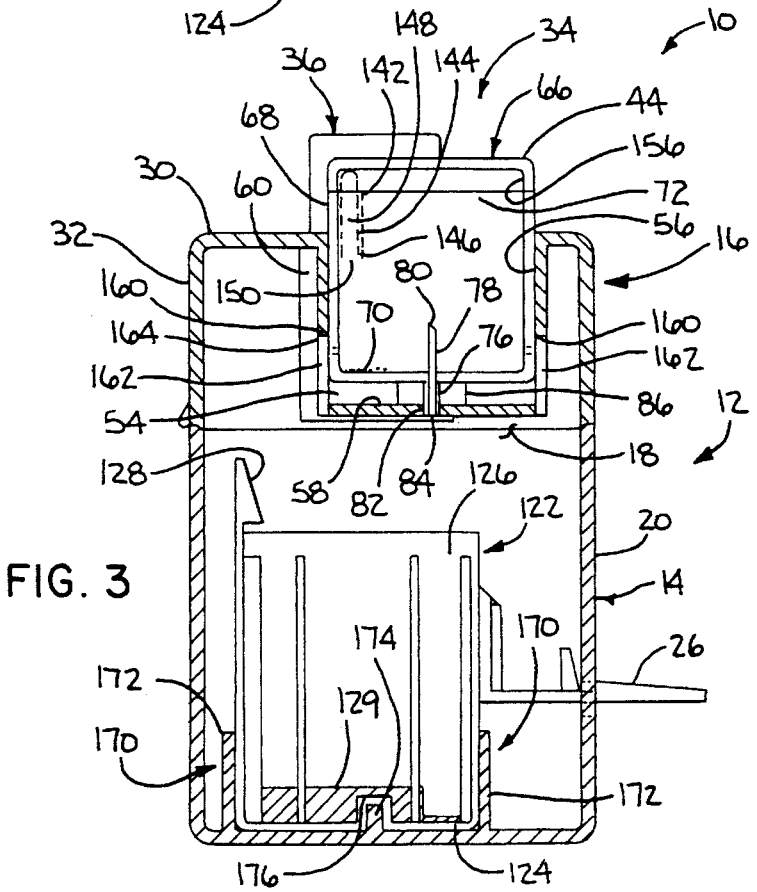
FIG. 3 illustrates a cross-sectional end side view FIG. 1 taken along the line 3—3.

Turning now to FIG. 3, there is illustrated a cross-sectional end view of another embodiment of the refilling structure 10 of the present invention. In this particular embodiment, the lid member 74 of the ink refill cartridge housing member 66 has a latch means 142, shown in phantom, for latching the pivotally mounted lid member 74 to the ink refill cartridge housing member 66. When the ink refill cartridge housing member 66 is in an upward position, i.e. not depressed against the resilient means 86, the latch means 142 latches the pivotally mounted lid member 74 to the ink refill cartridge housing member 66, thereby preventing the lid member 74 from being lifted. However, when the ink refill cartridge housing member 66 is fully depressed against the resilient means 86, the latch means 142 disengages from the lid member 74 and allows the lid member 74 to be lifted.

Figure 3A:
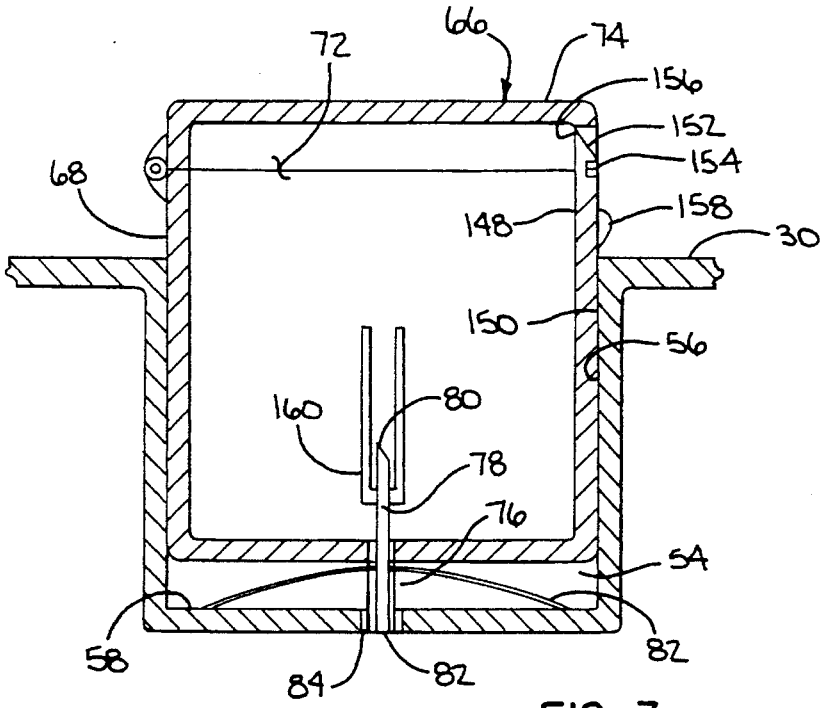
FIG. 3*a* illustrates an enlarged cross-sectional front side view of the ink injection means in its upward position.
Figure 3B:
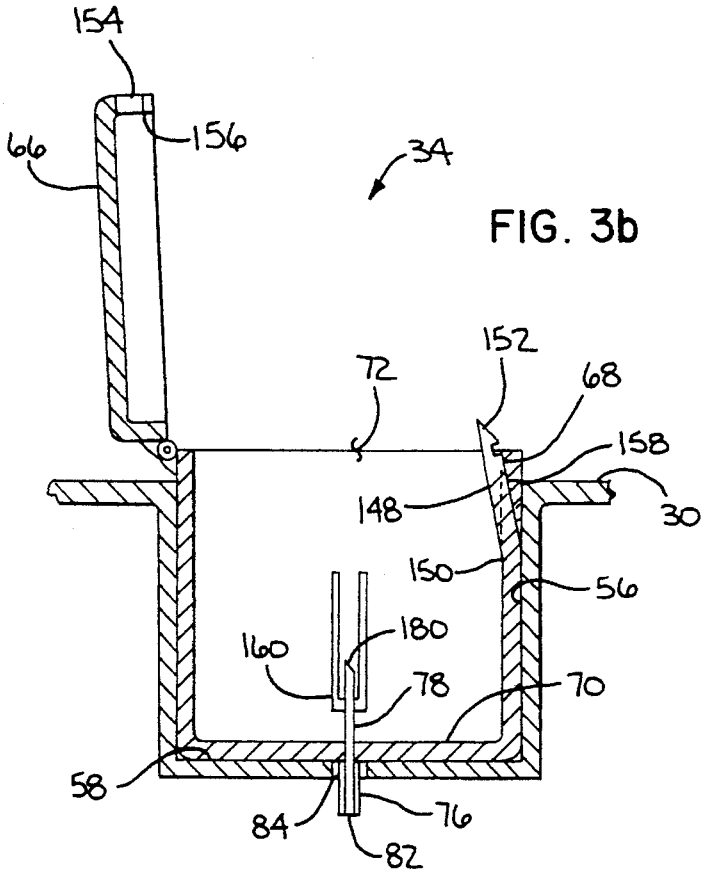
FIG. 3*b* illustrates an enlarged cross-sectional front side view of the ink injection means in its full downward position.

Referring now to FIGS. 3, 3*a* and 3*b*, the latch means 142 comprises a vertically extending slot 144 formed through the exterior side wall of the ink refill cartridge housing member 66, having a lower end 146 terminating within the exterior side wall of the ink refill cartridge housing member 66. A vertically extending, flexible, elongated lever member 148 is positioned in and co-planar with the vertically extending slot 144. The lever member 148 has a first stationary end 150 formed from the exterior side wall at the point of termination of the lower end 146 of the slot 144 and a movable second end 152 engageable with a latching indentation 154 formed within the interior surface of the side wall 156 of the lid member 74. The lever member 148 also has a an intermediate positioned projection member 158 extending outwardly therefrom that is operable against the interior side wall 56 of the first chamber 54 to thereby disengage the second end 152 from the latching indentation 154 in an inwardly direction when the ink refill cartridge housing member 66 is pressed downwardly.

The ink refill cartridge housing member 66 is held within the first chamber 54 by flexible retaining tab members 160 that project outwardly from the exterior side walls 68 of the ink refill cartridge housing member 66. The retaining tab members 160 are received in a recessed portion 162 formed in the interior side walls 56 of the first chamber 54 and are lockingly engageable against the upper end 164 of the recessed portion 162. The retaining tab members 160 and the corresponding recessed portions 162 are configured to allow the ink refill cartridge housing member 66 to be pushed downwardly but are also configured to prevent the ink refill cartridge housing member 66 from being pushed upwardly and out of the first chamber 54 by the resilient means 86. As previously mentioned, the retaining tab members 160 are identical in form and function to the air plunger tab members 104.

Figure 3C:
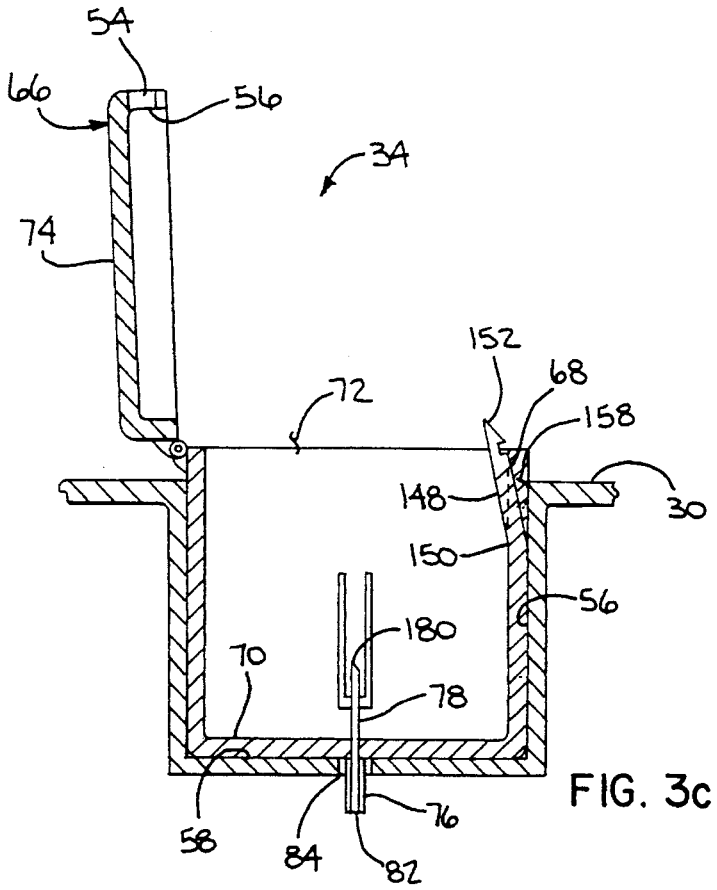
FIG. 3*c* illustrates an enlarged cross-sectional front side view of the ink injection means retaining tab means.
Figure 3D:
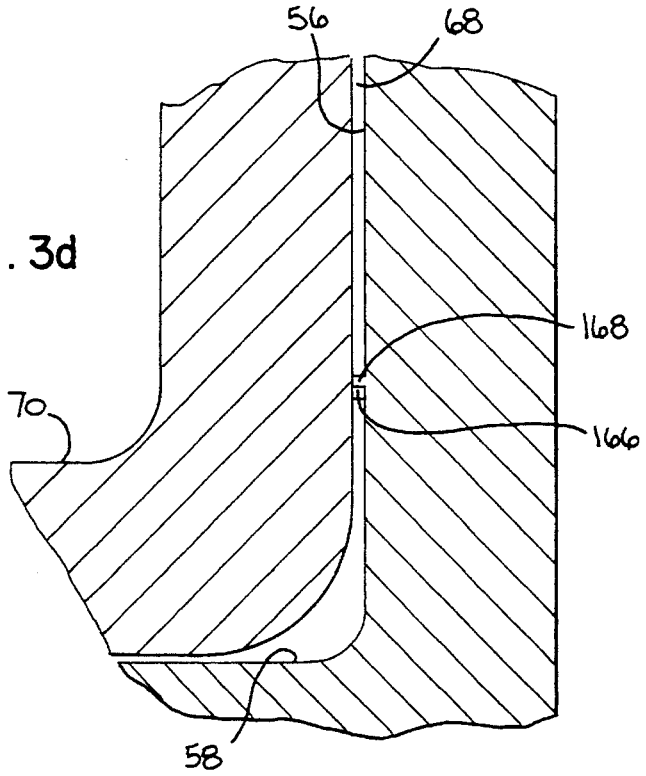
FIG. 3*d* illustrates an enlarged view of the lower right-hand portion of FIG. 3*c*.

Turning now to FIG. 3*c*, there is illustrated the ink refill cartridge housing member 66 having a second retaining tab member 166 for holding the ink refill cartridge housing member 66 in a downward position when the ink refill cartridge housing member 66 is pressed in a downward position against the resilient means 86. The tab member 166 is comprised of a tab member that projects outwardly from the exterior side wall 68 at the bottom portion of the ink refill cartridge housing member 66. The second retaining tab member 166 holds the ink refill cartridge downward by cooperating with a corresponding retaining tab member 168 that projects inwardly from the interior side wall 56 of the first chamber 54. When the ink refill cartridge housing member 66 is fully pressed downward, the retaining tab member 168 lockingly engages underneath the retaining tab member 168 as illustrated in FIG. 3*c*. The retaining tab members 166 and 168 are flexible enough to be lockingly engaged and disengaged yet rigid enough to prevent the resilient means 86 from pushing the ink refill cartridge housing member 66 in an upwardly direction when the retaining tab member 166 and 168 are engaged. The retaining tab members 166 and 168 may be disengaged by the user simply pulling the ink refill cartridge housing member 66 in an upward direction with sufficient force to overcome the engaged tab members.

Returning now to FIG. 3, the base structure 14 includes register means 170 for keeping the carrier member 122 properly aligned and in register as it is moved across the hollow base structure 14 from a first position to a second position. Preferably, the register means 170 are a plurality of parallel track walls that project upwardly from the base wall 24 of the base structure 14 and extend longitudinally across the base structure 14. More preferably, however, the register means 170 are three track walls with two oppositely disposed outer track walls 172 having a distance between them and a height sufficient to hold the carrier member 122 in proper alignment and a shorter intermediate track wall 174 positioned between the two outer walls that is configured to be received by an inwardly projecting slot 176 formed in the bottom wall of the carrier member 122. Additionally, the carrier member lever 26 is secured to the side wall 126 of the carrier member 122. As previously discussed, the lever 24 extends through the slot 22 and provides a convenient means for moving the carrier member 122 from one position to another within the interior of the hollow base structure 14. The lever 24 is preferably configured to be slightly biased against the upper portion of the slot 22 so that it will engage the locator slots 28 and 28*a* when at those respective positions.

Figure 4:
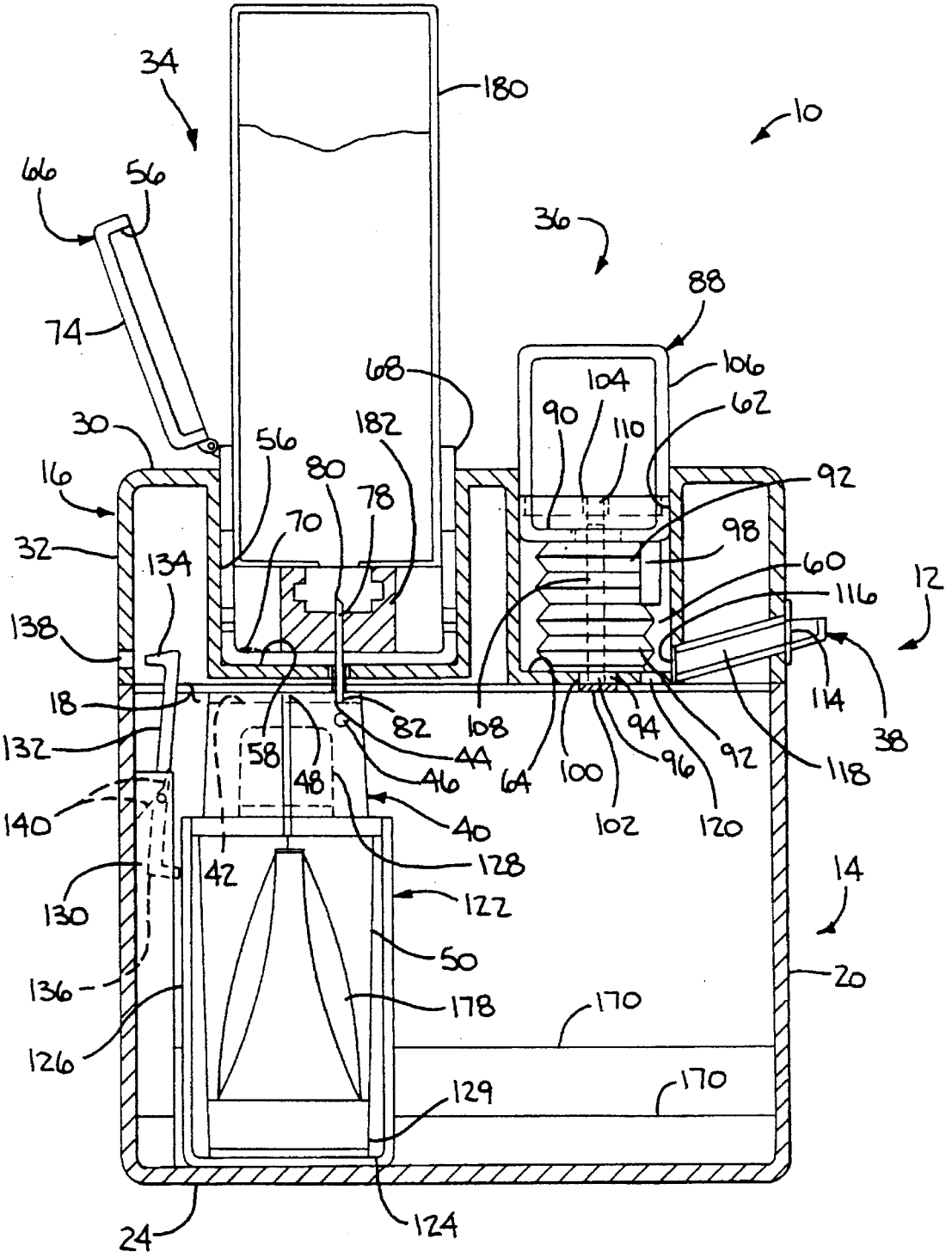
FIG. 4 illustrates a cross-sectional front side view with the ink charging cartridge and the ink cartridge positioned in the ink refilling positions.

Turning now to FIG. 4, there is illustrated a cross-sectional front side view of the refilling structure 10 with an ink cartridge 40 having air bags 178 contained therein and positioned in the carrier member 122. As illustrated, the carrier member 122 is positioned under the ink injection means 34. A pressurized ink refill cartridge 180 is also shown positioned in the ink refill cartridge housing member 66 with the refill needle 78 inserted through a septum 182 of the refill cartridge 180.

Figure 5:
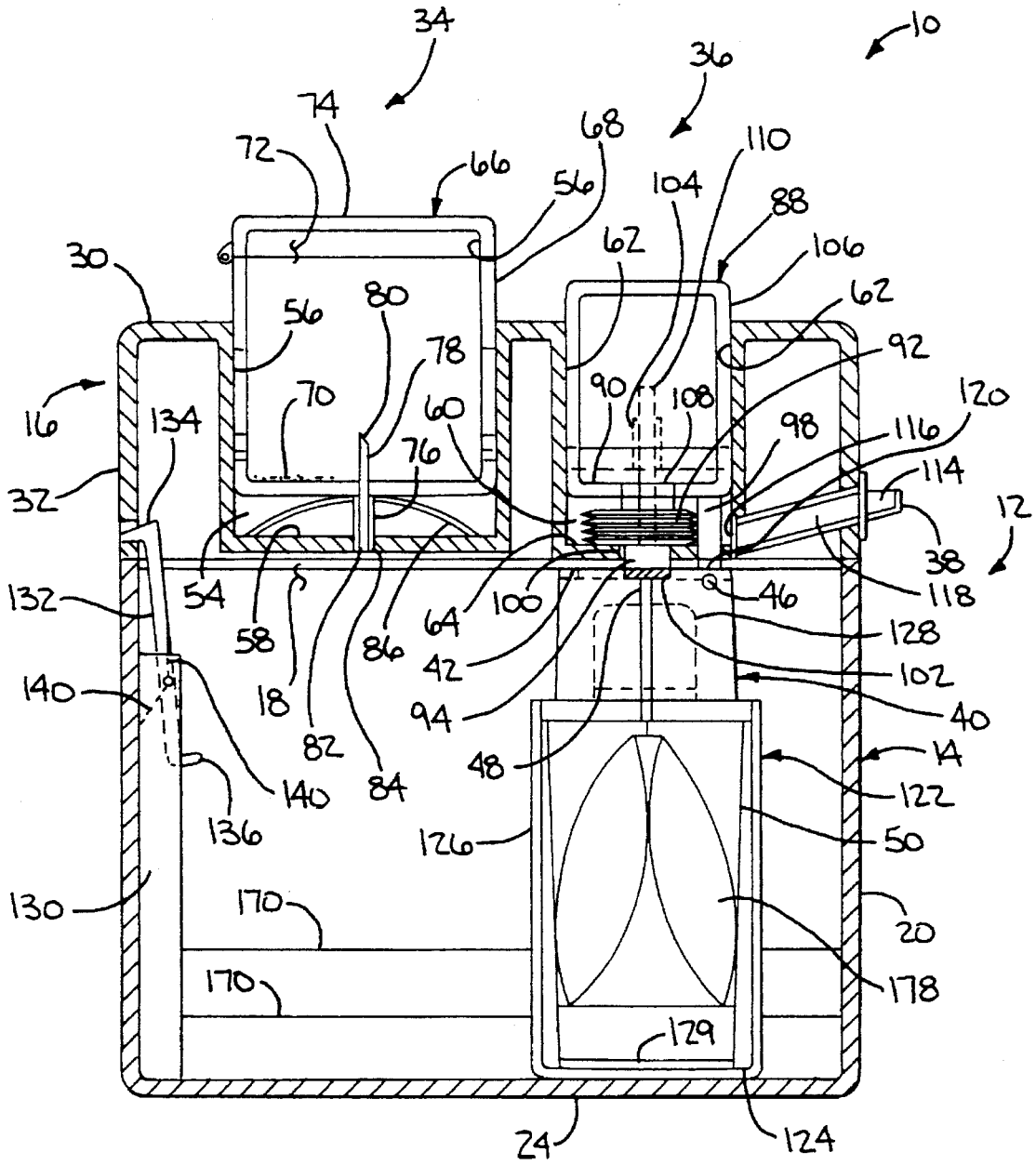
FIG. 5 illustrates a cross-sectional front side view with the inkjet printer ink cartridge positioned in air charging position.

Turning briefly to FIG. 5, the carrier member 122 is shown positioned under the air injection means 36. The air bellow member 92 is fully compressed and the seal ball 46 has been pushed into the ink filling port 44 by the ball ram member 98 that projects downwardly from the bottom wall 90 of the air plunger member 88. As illustrated, the air bags 178 are shown to have been inflated by the compression of the air bellow member 92.

In the operation of the refilling station 10, the lever 26 (see FIG. 1) is moved to position the carrier member 122 under the ink injection means 34 as shown in FIG. 4. Continuing to refer generally to FIG. 4, the side wall 126 of the carrier member 122 is forced against the lower end 136 of the latch member 132 which in turn disengages the upper end 134 of the latch member 132 from the latch opening 138 (see FIG. 3*b*). This allows the housing lid structure 16 to be lifted in an upward and open position which in turn, allows for the insertion of an empty ink cartridge 40 into the carrier member 122. Once the empty ink cartridge 40 is placed in the carrier member 122, the ink cartridge securing clip means is engaged with the securing tab member 52. The ink refill cartridge housing member 66 is opened by fully pressing the ink refill cartridge housing member 66 downward against the resilient means 86. As the ink refill cartridge housing member 66 is fully pressed downward, the retaining tab member 166 lockingly engages the retaining tab member 168 which holds the ink refill cartridge housing in the downward position. Simultaneously, the refill needle 78 and the tubular member 76 project downward through the opening 84 in the base wall 58 of the first chamber 54 and against the seal ball 46 to force it out of the ink filling port 44 and into the interior of the ink cartridge 40. When the ink refill cartridge housing member 66 is fully depressed, the latch means 142 is disengaged, thereby allowing the housing lid structure 16 to lifted upwardly in an open position. The ink refill cartridge 180 is forced downwardly onto the sharp end 80 of the refill needle 78 which causes the sharp end 80 to penetrate through the septum 182 and into the interior of the ink refill cartridge 180. The pressure within the ink refill cartridge 180 quickly forces the ink through the hollow refill needle 78, through the ink filling port 44 and into the ink interior of the ink cartridge 40. The ink cartridge 40 is removed and the refill cartridge housing member 66 is returned to its upward position by the user removing the empty refill cartridge 180 with a sufficient upward force to disengage the retaining tab members 166 and 168.

Referring now generally to FIG. 5, after the ink cartridge 40 has been recharged with ink, the carrier member 122 containing the ink cartridge 40 is moved under the air injection means 36 by pressing downwardly on the lever 26, thereby disengaging it from the first locator slot 28 and sliding the lever 26 along the longitudinally extending slot 22 (see FIG. 1) toward the air injection means 36. The register means 170 keeps the carrier member 122 in proper alignment within the interior of the hollow base structure 18. When the lever 26 is engaged with the oppositely disposed second locator slot 28*a*, the carrier member 122 and thus the ink cartridge 40 are correctly positioned under the air injection means 36.

As the carrier member 122 is moved toward the air injection means 36, the side wall 126 of the carrier member 122 disengages the lower end 136 of the latch member 132 which allows the resilient means 140 to pivot the upper end 134 into the latch opening 138 in the side wall 32 of the housing lid structure 16. (see FIG. 5.)

When the carrier member 122 is correctly positioned under the air injection means 36, a seal ball 46 is placed in the first end 114 of the ball chute 112. Given the downward projecting angle of the ball chute 112, the seal ball 46 rolls downwardly through the chute portion 118 and out the second end 116 of the ball chute 112 and into the second chamber 60 where it seats on the seal ball opening 120 (see FIG. 5).

As the air plunger member 88 is pressed downwardly, the air bellow member 92 is compressed. With the compression of the air bellow member 92, the bottom end member 94 with the affixed rubber seal 102 extends slightly through the second chamber air injection opening 100 to seal against the top surface 42 and over the air injection port 48 of the ink cartridge 40. Approximately 3.5 to 4 cubic centimeters of air from the air bellow member 92 is forced through the air injection opening 100 into the air bags 178 within the interior of the ink cartridge 40 when the air bellow member 92 is fully pressed downward. Simultaneously, with the full compression of the air bellow member 92, the ball ram member 98 forces the seal ball 46 through the seal ball opening 120 and into the ink filling port 44. The air plunger member 88 is released and the resilient air bellow member 92 expands to its original non-compressed configuration by drawing air from the interior portion of the base structure 14 through the air bellow opening 96. The lever 26 is disengaged from the locator slot 28*a* by pressing the lever 26 downwardly. The lever 26 is moved to the ink injection position which in turn also simultaneously moves the carrier member 122 and the ink cartridge 40. As the carrier member 122 is returned to the ink injection position, the side wall 126 of the carrier member 122 engages the lower end 136 of the latch member 132 and pivots the upper end 134 out of the latch opening 138. The housing lid structure 16 is then lifted and the refilled ink cartridge 40 is removed.

Although the present invention and its advantages have been described in detail, it should be understood that various changes, substitutions and alterations can be made herein without departing from the spirit and scope of the invention as defined by the appended claims.

What is claimed is:

1. A liquid refilling apparatus for refilling a liquid-containing cartridge, said apparatus comprising:

a housing structure having a top portion with a first chamber formed therein and a lower portion, said lower portion having a second chamber to receive a liquid-containing cartridge therein;

a liquid injector received in said first chamber of said top portion for injecting a liquid into said liquid-containing cartridge, said liquid injector having a cavity formed therein, a said cavity provided to receive a liquid refill cartridge therein and having a passageway formed through, said cavity provided to allow a flow of said liquid from said liquid refilling cartridge into said lower portion of said housing structure; and an air injector received in said top portion for injecting air into a liquid-containing cartridge positioned within said second chamber of said lower portion of said housing structure, said air injector having an air storage chamber with an air passageway extending from said air storage chamber to said lower portion of said housing structure, said air passage was provided to allow a flow of air from said air injector to said lower portion of said housing.

2. The liquid refilling apparatus of claim 1 wherein said chamber formed in said top portion opens outwardly from said top portion, said chamber having a side wall joined to a base wall and configured to receive said liquid injector therein, said chamber further having an opening therein interconnected with said passageway for providing fluid communication between said liquid injector and a liquid-containing cartridge positioned within said housing structure.

3. The liquid refilling apparatus of claim 2 wherein said liquid injector comprises:

a liquid refilling cartridge housing structure having a side wall extending upwardly from a base wall to form an open top portion thereof, said liquid refill cartridge housing structure slidably received in said chamber;

a liquid refill needle projecting from said base wall of said chamber and having a first end extending into said liquid refill cartridge housing structure through a liquid refill needle opening in said base wall of said liquid refill cartridge housing structure and a second end extending into said base wall of said chamber through a tubular member integrally formed with and extending upwardly from said base wall of said chamber; and a resilient member positioned between said base wall of said liquid refill cartridge housing structure and said base wall of said chamber for exerting an upwardly projecting force against said liquid refill cartridge housing structure.

4. The liquid refilling apparatus of claim 3 wherein said liquid refill cartridge housing member further comprises:

a lid member pivotally mounted to said liquid refill cartridge housing structure for covering said top portion of said liquid refill cartridge housing structure, said lid member having a top side surface and an outer edge side wall depending from said top side surface; and a lid latching assembly for latching said lid member to said liquid refill cartridge housing structure to thereby prevent said lid from being lifted to an open position when said liquid refill cartridge housing structure is in an upward position.

5. The liquid refilling apparatus of claim 4 wherein said lid latching assembly comprises:

an elongated slot formed through said side wall of said liquid refill cartridge housing structure, said elongated slot having a first end with a termination point within said side wall of said liquid refill cartridge housing structure:

a flexible elongated lever member positioned in and co-planar with said elongated slot, said flexible elongated lever member having a stationary end secured to said side wall at said termination point and a movable end engageable with a latching indentation formed within an interior surface of said outer edge side wall of said lid member, said movable end further having a projection member extending outwardly therefrom operable against said side wall of said chamber to thereby disengage said movable end from said latching indentation when said liquid refill cartridge housing is pressed into said chamber.

6. The liquid refilling apparatus of claim 1 further comprising a second chamber formed in and opening outwardly from said top portion of said housing structure and having a side wall joined to a base wall, said second chamber configured to receive said air injector therein and further having an opening therein for allowing air to flow from said air injector to an interior of a liquid-containing cartridge positioned within said housing structure.

7. The liquid refilling apparatus of claim 6 wherein said air injector comprises:

an air bellow member having a bottom end portion with an opening therein for injecting air from said air bellow member into a liquid-containing cartridge positioned within said housing structure;

an air plunger member having a bottom wall that is operable against said air bellow member, said air bellow member and air plunger member being slidably received in said second chamber; and a ball ram member secured to and extending downwardly from said bottom wall of said air plunger member.

8. The liquid refilling apparatus of claim 1 wherein said housing structure has received therein a cartridge carrier member.

9. The liquid refilling apparatus of claim 8 wherein said cartridge carrier member has a bottom wall and a side wall extending upwardly from said bottom wall to receive and hold said liquid-containing cartridge.

10. The liquid refilling apparatus of claim 8 wherein said housing structure cartridge carrier member is movable from a first position to a second position within said housing structure.

11. The liquid refilling apparatus of claim 6 wherein said top portion of said housing structure is a pivotally mounted housing lid structure having a top side surface and a side wall depending from said top side surface and wherein said housing structure further comprises a base wall, a side wall extending upwardly from said base wall to form an open top portion thereof, said housing lid member being configured to cover said open top portion of said housing structure.

12. The liquid refilling apparatus of claim 8 wherein said housing structure further comprises a register assembly within said housing for slidably receiving and properly aligning said cartridge carrier member as said cartridge carrier member is moved between said first and second positions.

13. The liquid refilling apparatus of claim 12 wherein said register assembly includes a plurality of parallel track walls that project upwardly from said base wall of said base wall and extend longitudinally across said base wall.

14. The liquid refilling apparatus of claim 13 wherein said plurality of parallel track walls include two oppositely disposed, spaced-apart outer track walls extending upward from and extending along a length of said base wall and an intermediate track wall positioned between said two outer track walls and extending upwardly from said base wall and said cartridge carrier member received between said two outer track walls and having a register slot formed in said bottom wall of said cartridge carrier member configured to slidably engage said intermediate track.

15. The liquid refilling apparatus of claim 7 wherein said second chamber further comprises a seal ball opening formed therethrough adjacent said lower portion of said housing structure and aligned with said ball ram, said seal ball opening configured to allow a seal ball to pass therethrough to seal a liquid-containing cartridge positioned within said lower portion of said housing structure when said ball ram engages said seal ball positioned within said seal ball opening.

16. The liquid refilling apparatus of claim 15 wherein said housing lid member further has a ball chute extending inwardly through said side wall, said ball chute having a first end opening outwardly from said side wall of said housing lid structure, a second end opening into said second chamber and a chute portion extending inwardly from said first end to said second end, said chute portion being angled downwardly with a sufficient degree of slope to cause a seal ball to roll downwardly from said first end to said second end to be operatively positioned in said seal ball opening.

17. The liquid refilling apparatus of claim 1 wherein said housing structure further comprises a side wall having a slot formed therethrough and extending longitudinally and horizontally along a partial length of said side wall, said slot configured to receive therethrough a carrier lever extending from an interior of said housing structure and exterior to said housing structure, said carrier lever secured to said cartridge carrier member for movement therewith.

18. The liquid refilling apparatus of claim 11 wherein said housing structure comprises a housing lid structure latch assembly for latching said housing lid structure to said housing structure to prevent said housing lid structure from being lifted to an open position when said cartridge carrier member is in said second position.

19. The liquid refilling apparatus of claim 18 wherein said housing lid structure latch assembly comprises:

a latch member support structure secured on an interior of said side wall of said housing structure;

an elongated lever pivotally mounted to said latch support structure, said elongated lever having upper end and lower end portions, said upper end portion of said elongated lever removably engagable with a latch opening formed in said side wall of said housing lid structure and said lower end portion engagable against said side wall of said cartridge carrier member when said cartridge carrier member is in said first position; and a housing lid latch resilient member for pivotally biasing said upper end of said elongated lever into said latch opening when said cartridge carrier member is in said second position.

20. An ink refilling apparatus for refilling an ink cartridge, said apparatus comprising:

a housing structure having a base portion and a side wall extending upwardly from said base portion to form an interior portion and an open top portion;

a movable housing lid structure configured to cover said open top portion, said housing lid structure having a side wall depending therefrom;

a first chamber formed in and opening outwardly from said top side surface of said housing lid structure having a side wall and a base wall, said first chamber having a first opening said first opening provides a fluid communication between said first chamber and said interior portion of said housing structure;

a second chamber formed in and opening upwardly from said top side surface of said housing lid structure, said second chamber having a second opening therein, said second opening allows air to flow from said second chamber to the interior said housing structure;

an ink injector received in said first chamber, said ink injector provided for injecting ink into an ink cartridge, said ink injector having a cavity formed therein configured to receive an ink cartridge therein, said ink injector cooperable with said first opening to allow ink to flow from said ink injector through said first opening into said interior portion of said housing structure; and an air injector received in said second chamber, said air injector provided for injecting air into said ink cartridge, said air injection means cooperable with said second opening to allow air to flow from said air injector into said interior portion of said housing structure.

21. The ink refilling apparatus of claim 20 wherein said ink injector comprises:

an ink refill cartridge housing member having a side wall extending upwardly from a base wall to form an open top portion thereof, said ink refilling cartridge housing slidably received in said first chamber;

an ink refilling needle projecting from said base wall of said first chamber and having a first end extending into said ink refill cartridge housing and a second end extending into said base wall of said first chamber through a tubular member integrally formed with and extending upwardly from said base wall of said first chamber; and a resilient member positioned between said base wall of said ink refill cartridge housing and said base wall of said first chamber for exerting an upwardly projecting force against said ink refill cartridge housing.

22. The ink refilling apparatus of claim 20 wherein said second chamber further comprises a seal ball opening therein for allowing a seal ball to pass therethrough and into an ink injection port of an ink cartridge positioned within said base portion of said housing structure.

23. The ink refilling apparatus of claim 20 wherein said movable housing lid structure further has a ball chute formed inwardly through said side wall of said housing lid structure, said ball chute having a first end opening outwardly from said side wall of said housing lid structure, a second end opening into said second chamber and a chute portion extending inwardly from said first end to said second end, said chute portion being angled downwardly with a sufficient degree of slope to cause a seal ball to roll downwardly from said first end to said second end to be operatively positioned in said seal ball opening.

24. The ink refilling apparatus of claim 20 wherein said housing structure further comprises a side wall having a slot formed therethrough and extending longitudinally and horizontally along a partial length of said side wall, said slot configured to receive therethrough, a carrier lever extending from an interior of said housing structure to an exterior of said housing structure, said carrier lever secured to said cartridge carrier member for movement therewith.

25. The ink refilling apparatus of claim 20 wherein said housing structure further comprises a housing lid structure latch assembly for latching said housing lid structure to said housing structure to prevent said housing lid structure from being lifted to an open position when said cartridge carrier member is in said second position.

26. The ink refilling apparatus of claim 20 wherein said air injector comprises:

an air bellow member having a bottom end portion with an opening therein for injecting air from said air bellow member into an ink cartridge positioned within said housing structure;

an air plunger member having a bottom wall that is operable against said air bellow member, said air bellow member and air plunger member being slidably received in said second chamber; and a ball ram member secured to and extending downwardly from said bottom wall of said air plunger member.

27. The ink refilling apparatus of claim 20 wherein said ink refilling cartridge housing member further comprises:

a lid member pivotally mounted to said ink refilling cartridge housing for covering said open top portion of said ink refilling cartridge housing member, said lid member having a top side surface and an outer edge side wall depending from said top side surface; and a lid latching assembly for latching said lid to said ink refilling cartridge housing member to prevent said lid from being lifted to an open position when said ink refilling cartridge housing member is in an upward position.

28. The ink refilling apparatus of claim 27 wherein said lid latching assembly comprises:

an elongated slot formed through said side wall of said ink refill cartridge housing structure said elongated slot having a first end with a termination point within said side wall of said ink refill cartridge housing structure;

a flexible elongated lever member positioned in and co-planar with said elongated slot, said flexible elongated lever member having a stationary end secured to said side wall at said termination point and a movable end engageable with a latching indentation formed within an interior surface of said outer edge side wall of said lid member, said movable end further having a projection member extending outwardly therefrom operable against said side wall of said first chamber to thereby disengage said movable end from said latching indentation when said ink refill cartridge housing is pressed into said first chamber.

29. The ink refilling apparatus of claim 20 wherein said housing structure has received therein an ink cartridge carrier member and said housing structure further comprises a housing lid structure latch assembly for latching said housing lid to said housing lid structure to prevent said housing lid structure from being lifted to an open position when said cartridge carrier member is in said second position.

30. The ink refilling apparatus of claim 29 wherein said housing structure ink cartridge carrier member is movable from a first position to a second position within said housing structure.

31. The ink refilling apparatus of claim 30 wherein said housing lid structure latch assembly comprises:

a latch member support structure secured on an interior of said side wall of said housing structure;

an elongated lever pivotally mounted to said latch support structure, said elongated lever having upper end and lower end portions, said upper end portion of said elongated lever removably engagable with a latch opening formed in said side wall of said housing lid structure and said lower end portion engagable against said side wall of said ink cartridge carrier member when said ink cartridge carrier member is in said first position; and a housing lid latch resilient member for pivotally biasing said upper end of said elongated lever into said latch opening when said ink cartridge carrier member is in said second position.

32. The ink refilling apparatus of claim 31 wherein said housing structure further comprises a register assembly receiving and properly aligning said ink cartridge carrier member as said ink cartridge carrier member is moved between said first and second positions.

33. The liquid refilling apparatus of claim 32 wherein said register assembly includes a plurality of parallel track walls that project upwardly from said base wall of said base wall and extend longitudinally across said base wall.

34. The liquid refilling apparatus of claim 33 wherein said plurality of parallel track walls include two oppositely disposed, spaced-apart outer track walls extending upwardly from and extending along a length of said base wall and an intermediate track wall positioned between said two outer track walls and extending upwardly from said base wall and said ink cartridge carrier member received between said two outer track walls and having a register slot formed in said bottom wall of said ink cartridge carrier member configured to slidably engage said intermediate track.

35. An ink refilling apparatus for refilling an ink cartridge, said apparatus comprising:

a housing structure having a base portion and a side wall extending upwardly from said base portion to form an interior portion and an open top portion;

a movable housing lid structure configured to cover said open top portion, said housing lid structure having a top side surface and a side wall depending therefrom;

a first chamber formed in and opening outwardly from said top side surface of said housing lid structure and having a side wall and a base wall, said first chamber having a first opening therein, said first opening providing a fluid communication between said first chamber and said interior portion of said housing structure;

a second chamber formed in and opening outwardly from said top side surface of said housing lid structure, said second chamber having a second opening therein, said second opening allows a flow of air from said second chamber to said interior portion of said housing structure;

an ink refilling cartridge housing structure having a side wall extending upwardly from a base wall to form an open top portion thereof, said ink refill cartridge housing structure slidably received in said first chamber;

an ink refilling needle projecting from said base wall of said first chamber and having a first end extending into said ink refill cartridge housing structure and a second end extending into said base wall of said first chamber through a tubular member integrally formed with and extending upwardly from said base wall of said first chamber;

a resilient assembly positioned between said base wall of said ink refill cartridge housing structure and said base wall of said first chamber, said resilient assembly provided for exerting an upwardly projecting force against said ink refilling cartridge housing;

an air bellow member having an bottom end portion with an opening therein in fluid communication with said second opening in said second chamber;

an air plunger member having a bottom wall engageable against said air bellow member, said air bellow member and said air plunger member slidably received in said second chamber; and a ball ram member extending downwardly from said bottom wall of said air plunger member.

36. The ink refilling apparatus of claim 35 wherein said second chamber further comprises a seal ball opening therein for allowing a seal ball to pass therethrough and into an ink injection port of an ink cartridge positioned within said base portion of said housing structure.

37. The ink refilling apparatus of claim 35 wherein said housing lid member further has a ball chute formed inwardly through said side wall, said ball chute having a first end opening outwardly from said side wall of said housing lid structure, a second end opening into said second chamber and a chute portion extending inwardly from said first end to said second end, said chute portion being angled downwardly with a sufficient degree of slope to cause a seal ball to roll downwardly from said first end to said second end to be operatively positioned in said seal ball opening.

38. The ink refilling apparatus of claim 35 wherein said housing structure further comprises a side wall having a slot formed therethrough and extending longitudinally and horizontally along the length of said side wall, said slot configured to receive therethrough, a carrier lever extending from an interior of said housing structure to an exterior of said housing structure, said carrier lever secured to said cartridge carrier member for movement therewith.

39. The ink refilling apparatus of claim 35 wherein said housing structure further comprises a housing lid structure latch assembly for latching said housing lid to said housing lid structure to prevent said housing lid structure from being lifted to an open position when said cartridge carrier member is in said second position.

40. The ink refilling apparatus of claim 39 wherein said housing lid structure latch assembly comprises:

a latch member support structure secured on an interior of said side wall of said housing structure;

an elongated lever pivotally mounted to said latch support structure, said elongated lever having upper end and lower end portions, said upper end portion of said elongated lever removably engagable with a latch opening formed in said side wall of said housing lid structure and said lower end portion engagable against said side wall of said ink cartridge carrier member when ink said cartridge carrier member is in said first position; and a housing lid latch resilient member for pivotally biasing said upper end of said elongated lever into said latch opening when said ink cartridge carrier member is in said second position.

41. The ink refilling apparatus of claim 35 wherein said ink refilling cartridge housing structure further comprises:

a lid member pivotally mounted to said ink refilling cartridge housing for covering said open top portion of said ink refilling cartridge housing member, said lid member having a top side surface and an outer edge side wall depending from said top side surface; and a lid latching means for latching said lid to said ink refilling cartridge housing member to prevent said lid from being lifted to an open position when said ink refilling cartridge housing member is in an upward position.

42. The ink refilling apparatus of claim 41 wherein said lid latching assembly comprises:

an elongated slot formed through said side wall of said liquid refill cartridge housing structure, said elongated slot having a first end with a termination point within said side wall of said ink refill cartridge housing structure;

a flexible elongated lever member positioned in and co-planar with said elongated slot, said flexible elongated lever member having a stationary end secured to said side wall at said termination point and a movable end engageable with a latching indentation formed within an interior surface of said outer edge side wall of said lid member, said movable end further having a projection member extending outwardly therefrom operable against said side wall of said chamber to thereby disengage said movable end from said latching indentation when said ink refill cartridge housing is pressed into said first chamber.

43. The ink refilling apparatus of claim 35 wherein said housing structure has received therein an ink cartridge carrier member.

44. The ink refilling apparatus of claim 43 wherein said housing structure ink cartridge carrier member is movable from a first position to a second position within said housing structure.

45. The ink refilling apparatus of claim 35 wherein said housing structure further comprises a register assembly receiving and properly aligning said ink cartridge carrier member as said ink cartridge carrier member is moved between said first and second positions.

46. The liquid refilling apparatus of claim 45 wherein said register assembly includes a plurality of parallel track walls that project upwardly from said base wall of said base wall and extend longitudinally across said base wall.

47. The liquid refilling apparatus of claim 46 wherein said plurality of parallel track walls include two oppositely disposed, spaced-apart outer track walls extending upwardly from and extending along a length of said base wall and an intermediate track wall positioned between said two outer track walls and extending upwardly from said base wall and said ink cartridge carrier member received between said two outer track walls and having a register slot formed in said bottom wall of said ink cartridge carrier member configured to slidably engage said intermediate track.

* * * * *